United States Patent [19]

Gettmann

[11] 3,939,905

[45] Feb. 24, 1976

[54] SYSTEM FOR REGULATING THE TEMPERATURE IN ROOMS, MORE PARTICULARLY FOR COOLING ROOMS

[75] Inventor: Hermann Gettmann, Sythen, Germany

[73] Assignee: Tour Agenturer AB, Johanneshov, Sweden

[22] Filed: May 18, 1973

[21] Appl. No.: 361,554

[30] Foreign Application Priority Data

May 18, 1972 Germany ..... 2224242

[52] U.S. Cl. ..... 165/49; 62/93; 62/DIG. 1; 165/32

[51] Int. Cl.[2] ..... F24H 9/08

[58] Field of Search ..... 165/49, 45, 50, 32; 62/283, 93, 259, DIG. 1

[56] References Cited

UNITED STATES PATENTS

| | | | |
|---|---|---|---|
| 2,378,964 | 6/1945 | Williams | 62/283 |
| 2,392,240 | 1/1946 | Frankel | 62/DIG. 1 |
| 2,467,519 | 4/1949 | Borghesan | 165/49 |
| 2,783,616 | 3/1957 | Dodge | 62/93 |
| 2,784,945 | 3/1957 | Fodor | 165/45 |
| 3,001,382 | 9/1961 | Mills | 62/DIG. 1 |
| 3,009,331 | 11/1961 | Hewett | 62/DIG. 1 |
| 3,101,779 | 8/1963 | Yuen | 165/50 |
| 3,102,399 | 9/1963 | Meckler | 62/DIG. 1 |
| 3,313,123 | 4/1967 | Ware | 62/93 |
| 3,363,675 | 1/1968 | Bierhoff | 165/32 |
| 3,782,132 | 1/1974 | Lohoff | 165/49 |

*Primary Examiner*—Charles J. Myhre
*Assistant Examiner*—Daniel J. O'Connor
*Attorney, Agent, or Firm*—Armstrong, Nikaido & Wegner

[57] ABSTRACT

A method and apparatus is provided for reducing the moisture content of air in a room prior to cooling by a pipeline in a structural element of the room. The moisture content is reduced by passing the air through a heat exchanger which lowers the temperature to below the condensation point thus condensing the moisture in the air. The condensed moisture is removed and the air is then cooled by ordinary room cooling means.

12 Claims, 4 Drawing Figures

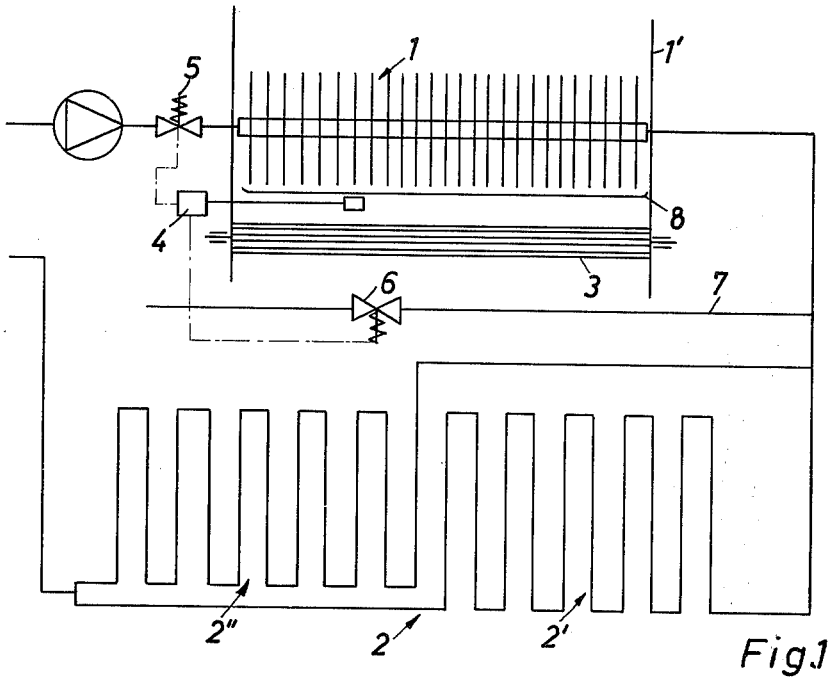
Fig.1
Fig.2
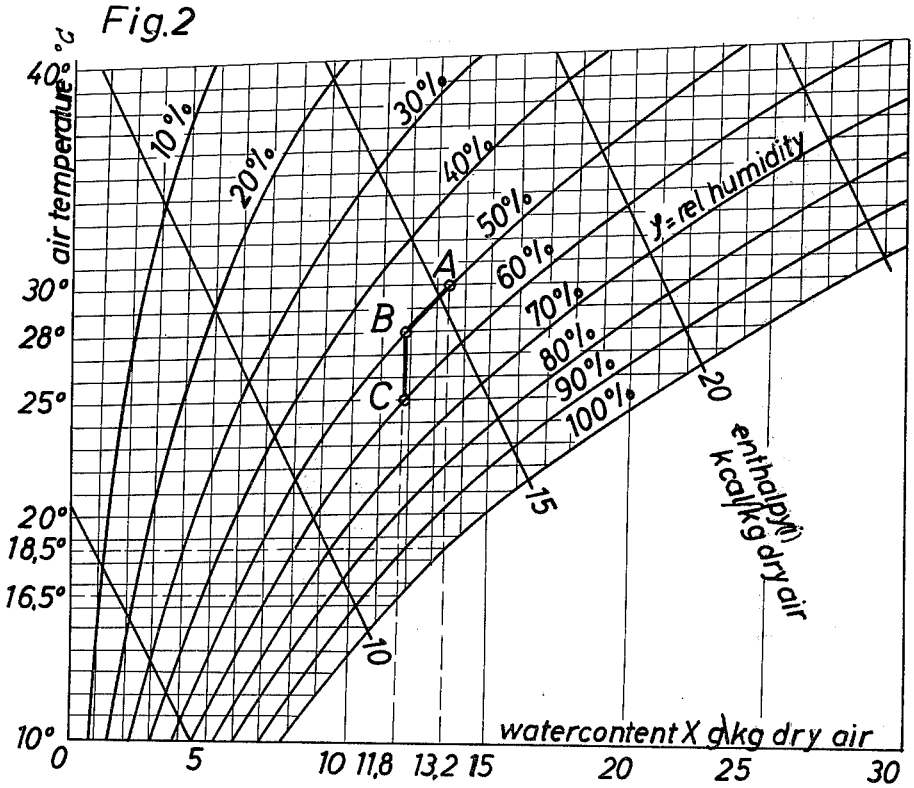

SYSTEM FOR REGULATING THE TEMPERATURE IN ROOMS, MORE PARTICULARLY FOR COOLING ROOMS

BACKGROUND OF THE INVENTION

1. Field of the Invention

The present invention relates to a method and system for regulating the temperature of rooms, more particularly, for cooling rooms, comprising a pipe line designed to be arranged in the structural layer of a floor, wall, or ceiling, and filled with a charge of water.

2. Description of the Prior Art

In known systems of the above-mentioned type, it is not possible to dehumidize the air in a room by reducing the latent heat contained therein, since when the surface temperature of the structural layer is below the condensation point of the air in the room, the water vapor in the air thus begins to condense on the structural layer. Apart from other unpleasant effects, it is then impossible to prevent the structural layer from being damaged. Existing systems have operated on the principle of cooling rooms by only reducing sensible heat, the condensation point of the air in the room thus confining the temperature range of the cooling water in the pipe line to within relatively narrow limits.

SUMMARY OF THE INVENTION

The object of the present invention is to provide a system of the above-mentioned type, which makes it possible to cool rooms by reducing both the latent and sensitive heat in the air, thereby providing full air conditioning. According to the invention, this problem is solved in that, in addition to being conveyed through the pipe line, water is also circulated through a heat exchanger having a large, external, heat transmission surface. This heat exchanger is arranged in the same room as the pipe line and is connected in series or in parallel therewith. In this way, in order to remove the latent heat, the heat exchanger is charged with cooling water having a forward flow temperature far below the condensation point of the air in the room in order to effectively dehumidize the room at the same time the sensible heat is removed over the large emitting surface, for example, of the floor, by means of the cooling water having a temperature slightly above the condensation point of the air in the room.

According to an advantageous feature of the invention, the heat exchanger and the pipe line are connected in series according to an inflow technique in a common forward flow line. In this way, the water leaving the heat exchanger at a temperature above condensation point can be sent directly into the forward flow of the pipe line for further cooling without any risk of incurring the disadvantages mentioned initially.

However, it is also possible to connect the heat exchanger and the pipe line in parallel according to the inflow technique in a common forward flow line; the forward flow line; the forward and return flow sections of the pipe line being interconnected via a three-way mixing valve and a regulating line. For providing very rapid and effective dehumidization and cooling of the air in a room, the heat exchanger and pipe line are connected to two different forward flow lines. The surface temperature of the pipe line may then correspond to the condensation point of the air in the room and the surface temperature of the heat exchanger can vary widely with respect to it. In the process it is essential to the invention that there is interaction between the dehumidization at the heat exchanger, on the one hand, and the cooling by the pipe line at the surface of the structural layer, for with increasing dehumidization, the condensation point of the air in the room drops, and with it also the allowable temperature of the cooling water in the pipe line, as the absolute moisture content of the air in the room is constantly decreasing.

The heat exchanger consists of a conventional convector, preferably being supplied with air by a radial fan, and being provided with a tray for catching the condensate being extracted by the same. This relatively simple arrangement consitutes an "air conditioning device," which, used jointly with the pipe line, provides an effective, complete, air-conditioning system for the room in question.

To prevent any damage from occurring when there is a power cut, i.e., when the fan cuts out, a wound filament relay is provided between the fan and the convector (as lone as the latter is connected in series with the pipe line). When a power cut occurs, this relay closes a magnetic valve to prevent the cold water from entering the pipe line.

According to another feature of the invention, an additional cooling unit is provided in front of the heat exchanger, to further cool the charge of water. This unit preferably consists of a refrigerator, on account of its high cooling capacity.

According to another particularly advantageous feature of the invention, the necessary cooling water is fed into a conventional electrically powered storage tank for cooling therein during the periods when electricity is supplied at reduced rate.

BRIEF DESCRIPTION OF THE DRAWINGS

Various embodiments of the system according to the invention are shown in the drawings, in which:

FIG. 1 shows a system with a heat exchanger and a pipe line connected in series in a common forward flow line, and constituting part of the overall system represented in FIG. 3, FIG. 2 is a Mollier-i-x diagram with lines showing the state of the air in a room during the cooling process.

DESCRIPTION OF THE PREFERRED EMBODIMENT

Figure 3:
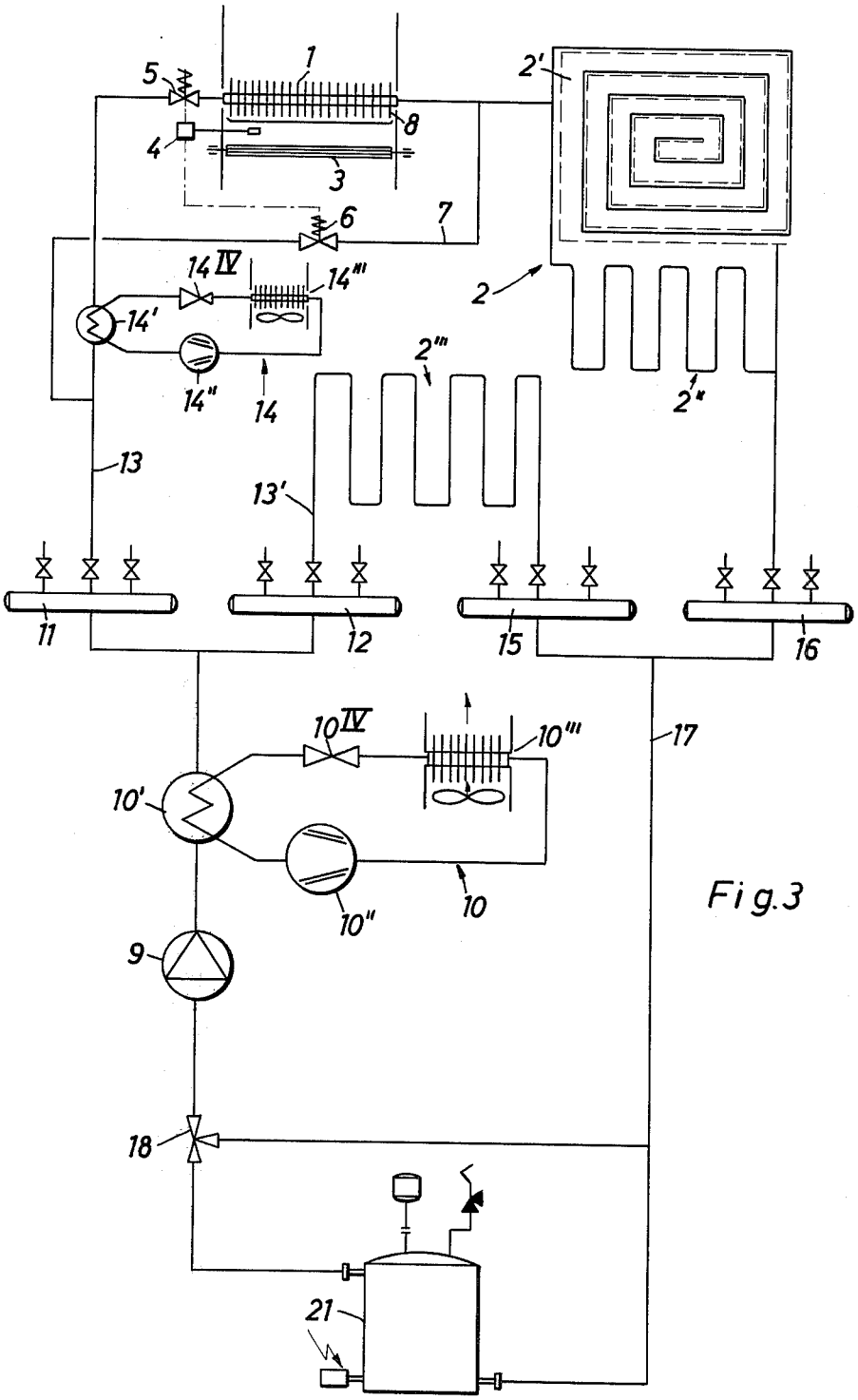
FIG. 3 is a circuit diagram of the overall system in which a heat exchanger is connected in series with a pipe line.

In FIG. 1, the heat exchanger is designated by 1. 2 designates the pipe line, which consists of the two partial pipe lines 2' and 2''. The exchanger 1 is in the form of a convector. A cylindrical radial fan 3 is rotatably mounted below the convector in the convector shaft 1'. A wound filament relay 4 is disposed in the convector shaft 1'. When a power cut-out occurs, the relay 4 closes the magnetic valve 5 in the forward flow section of the convector 1. In the event of a power cut-out, the relay 4 simultaneously opens the magnetic valve 6 to ensure the continued flow of cooling water into the pipe line 2 via the by-pass line 7, as may be seen from the top left hand section of FIG. 3. When this occurs, the cooling water flowing through the by-pass line 7 has a forward flow temperature, which is equivalent to or higher than the condensation point of the air in the room, as the cooling unit 14, which is connected in series, is also switched off at this juncture (see FIG. 3).

FIG. 2 represents the changing state of the air in the room during the cooling process using the system according to the invention. Starting with the air at point A at a temperature of 30° C and a relative humidity of 50%, the air in the room is cooled and dehumidized in the convector by a very cold charge of water with a temperature of, e.g., 6°–10°C, to a state B, i.e., to a temperature of 28° C and a 50% relative humidity. During the process of cooling air from A to B, the absolute water content $x$ of the air in the room decreases from ca. 13.2 to 11.8g water/kg dry air. This water content is condensed out in the convector 1 and drops into the tray 8 indicated in FIG. 1, from which it is removed. During the cooling and dehumidization process from state A to state B, the condensation point also decreases by about 2°C. This means that the pipe line 2 can now also be charged with a correspondingly colder charge of water having, for example, a temperature of 16.5°C, without any risk of condensate being produced on the surface of the structure surrounding the pipe line 2.

When the water leaves the convector 1, it has a higher temperature, which is preferably such that it is either equivalent to or slightly higher than the condensation point of the air at point B. In the case in question, this would mean that the temperature of the water leaving the convector would have to be at least 16.5°C. The pipe line 2 cools the air in the room from state B to state C with a temperature of 25°C and 60% relative humidity, without dehumidizing the air merely by reducing the sensitive heat. Cooling and dehumidization of the air from state A to state C constitutes a complete air conditioning process.

A complete diagram of the system according to the invention is represented in FIG. 3. The forward flow water is circulated by the pump 9 through the vaporizer 10' of a refrigerating unit 10, from where it proceeds to the two forward flow distributors 11 and 12. The water, which is precooled hereby to, for example, 18°C proceeds to the vaporizer 14' of an additionall refrigerating unit 14 via the forward flow line 13, and via the forward line 13' directly into a pipe line 2'''. The precooled water is further cooled in the vaporizer 14', for example, to 10°C. From there it proceeds to the heat exchanger 1 via the magnetic valve 5. The water is heated in the heat exchanger 1 to, for example, 16.5°C, and is then circulated through the two partial pipe lines 2' and 2'', which are connected in parallel. The partial pipe line 2' comprises a special feature in that its forward and return flow channels, by meeans of their directly juxtaposed position, form a counter-current heat exchanger, which, by reason of its counter-current arrangement, can be charged with forward flow water having a temperature below the condensation point of the air in a room. After the water has passed through the two partial pipe lines 2' and 2'' or 2''', it proceeds to the reflux accumulators 15, 16, and from these via the return flow line 17 and the three-way mixing valve 18 back to the pump 9, at which the cycle begins again. The two refrigerating units 10 and 14 consist essentially of the two above-mentioned vaporizers 10' and 14', and are each provided with a compressor 10'', 14'', which receives the cooling agent vaporized in the vaporizers 10', 14', compresses it, and force it into the condenser 10''', 14' ''. In the condenser 10''', 14''', the cooling agent is again condensed by heat extraction for example, by means of the aforementioned fan, and it returns to the vaporizer 10', 14', in the cooled state via the pressure reduction valve 10IV, 14IV.

Figure 4:
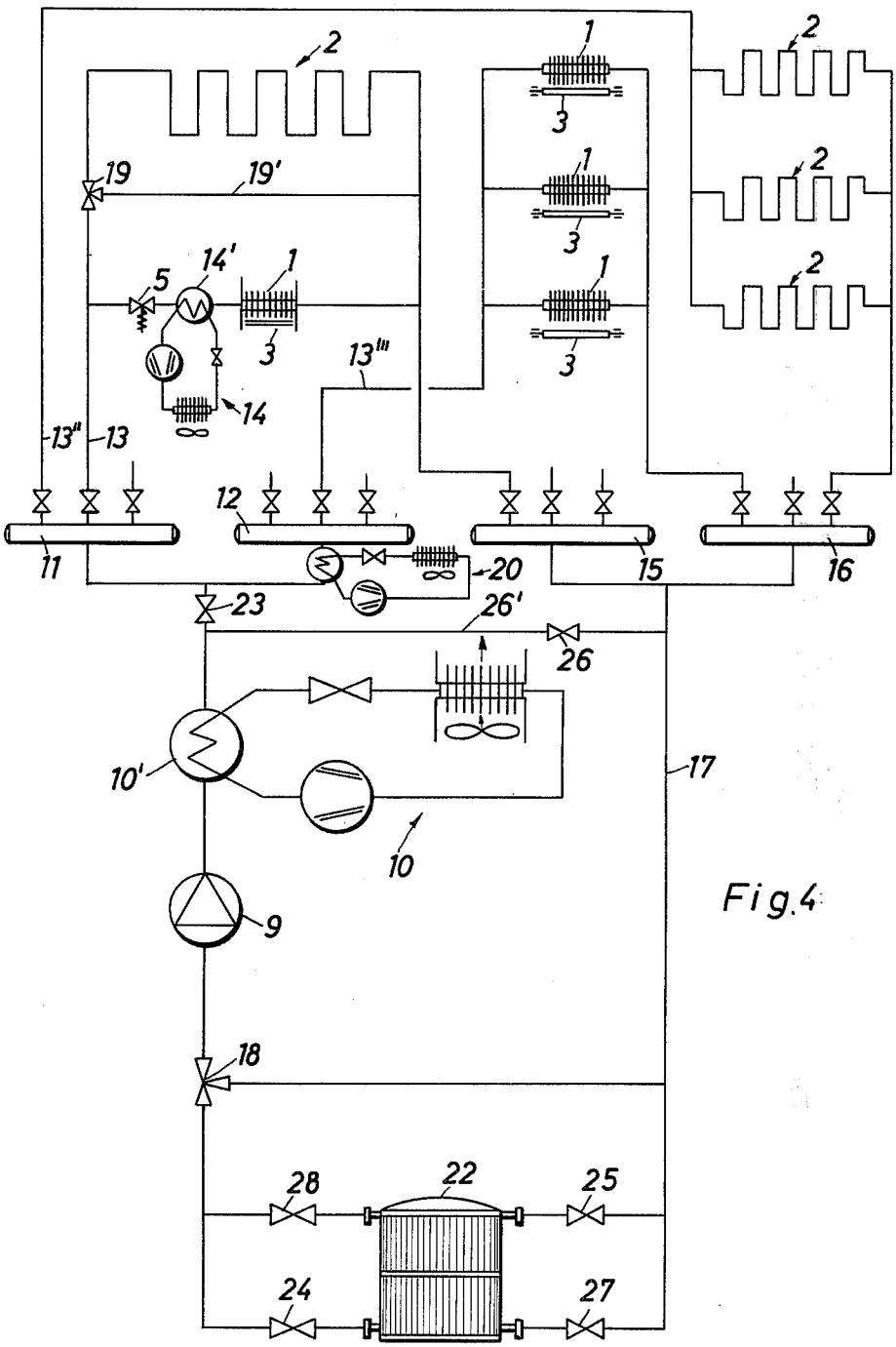
FIG. 4 is a circuit diagram of the entire system in which the heat exchangers and pipe lines are connected in parallel.

In FIG. 4, the forward flow water, precooled in the vaporizer 10' of the refrigerating unit 10, is circulated by the pump 9 via the forward flow distributor 11 and the forward flow line 13 via an additional three-way mixing valve 19 into the pipe line 2 and via the vaporizer 14' of the additional refrigerating unit 14 into the convector 1. The cooling water than proceeds to the reflux accumulator 15 and the reflux line 17 and returns to the pump 9.

In the right-hand portion of FIG. 4, a circuit is represented, in which several convectors 1 connected in parallel, and several pipe lines 2 connected in parallel, are connected to two different forward flow lines. In this case, the pipe lines 2 are supplied with water via the forward flow distributor 11 and the forward flow line 13'', while the convectors 1 are charged with water by the forward flow distributor 12 via the forward flow line 13''', the latter charge of water having a lower temperature than the precooled water in the forward flow line 13'' by reason of it being cooled by an additional cooling unit 20 in the form of a refrigerating unit.

According to a particularly advantageous feature of the invention, the water required for cooling the system is fed into a conventional, electrically powered storage tank and cooled during the periods when electricity is supplied at a reduced rate. To this end, the valves 23, 24 and 25 in FIG. 4 are closed and the valves 26, 27 and 28 are opened. The pump 9 then draws the non-cooled water out of the storage tank 22 via the valve 28 and circulates it through the vaporizer 10' of the refrigerating unit 10. From there it proceeds via the twin lead 26', the valve 26 and the valve 27 back into the storage tank 22, where it is filled from bottom to top. When cooling water is required — for example, when the refrigerating unit 10 is switched off during the peak tariff periods — the valves 26, 27, and 28, are again closed, the valves 23, 24, and 25, are again opened and the cooling water, with or without reflux admixture (by means of the three-way mixing valve 18) is drawn off from the bottom of the tank 22 to cool the convectors and/or the pipe lines 2', 2'', 2'''.

The above-mentioned pipe lines 2 and convectors 1 may obviously also be used to heat rooms. To this end, the requisite hot water is produced in a heating tank 21 or the storage tank 22, from where it is circulated in the above-described manner by pump 9 to the convectors 1 or the pipe lines 2.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all other changes which come within the meaning and range of equivalency of the claims are therefore intended to be embraced therein.

I claim:

1. A water circulation type cooling system for regulating the temperature of air in rooms comprising:

a. a pipeline means included in a structural member such as a floor, ceiling or wall, the pipeline means being supplied with a charge of water; and b. dehumidifier means in the room for reducing the temperature of the air to condense and remove moisture therefrom, the dehumidifier means comprising a convector coupled to the pipeline means, such that the charge water flows through the convector in series or in parallel with the charge water through the pipeline means, a blower and a collector tray for collecting the condensate from the convector, wherein the dehumidifier and pipeline means are positioned with respect to each other in the room, such that air first passes through the dehumidifier means and then is cooled by the pipeline means, whereby condensation on the structural members is reduced due to the removal of moisture by the dehumidifier means.

2. A system according to claim 1. wherein the blower is a radial fan.

3. A system according to claim 1, wherein the dehumidifier means and the pipe line means are arranged in series with common forward flow line.

4. A system according to claim 1, wherein the dehumidifier means and the pipe line means are connected in parallel said system including a common forward flow line and wherein the forward and return flow sections of the pipe line means are interconnected via a three-way mixing valve means and a by pass means.

5. A system according to claim 1, further including a plurality of forward flow lines wherein the dehumidifier means and the pipe line means are connected to two different forward flow lines.

6. A system according to claim 1, further including a relay arranged between the blower and the convector, said relay preventing the cold water from entering the pipe line means by closing a magnetic valve in response to the cut off of the fan.

7. A system according to claim 1, further including an additional cooling means for cooling the charge water still further the additional cooling means positioned in front of the dehumidifier means.

8. A system according to claim 5, further comprising an additional cooling means connected in, or in front of, the forward flow line of the heat dehumidifier.

9. A system according to claim 7 wherein the cooling means comprises refrigerating units.

10. A system according to claim 1, further including a storage tank wherein cooling water having a very low temperature or heating water having a very high temperature, may be supplied as desired to said storage tank.

11. A system according to claim 10 wherein said storage tank is a conventional electro-storage tank.

12. A system according to claim 11 wherein said tank is supplied with electric current during the reduced rate supply periods.

* * * * *